United States Patent [19]

Stoll

[11] Patent Number: 4,709,852

[45] Date of Patent: Dec. 1, 1987

[54] PRODUCE TRANSPORT AND COOLING CONTAINER AND METHOD FOR USING SAME

[75] Inventor: Mark S. Stoll, Deephaven, Minn.

[73] Assignee: Liberty Diversified Industries, Minneapolis, Minn.

[21] Appl. No.: 888,719

[22] Filed: Jul. 24, 1986

[51] Int. Cl.[4] ..... B65D 21/00; B65D 5/36

[52] U.S. Cl. ..... 229/119; 229/23 R; 229/185; 229/915; 229/916; 206/509

[58] Field of Search ..... 229/23 R, 23 A, 16 R, 229/6 R, 119, 163, 165, 169, 172, 173, 183, 185, 188, 916, 915, 120; 206/503, 506, 508, 509, 510–512

[56] References Cited

U.S. PATENT DOCUMENTS

| | | | |
|---|---|---|---|
| 3,952,941 | 4/1976 | Zimmerman | 229/41 B |
| 4,175,691 | 11/1979 | Cornell et al. | 229/915 |
| 4,238,068 | 12/1980 | Ellerbe et al. | 229/185 |
| 4,347,968 | 9/1982 | Cornell et al. | 229/23 |
| 4,386,729 | 7/1983 | Schmidt | 229/185 |
| 4,392,607 | 7/1983 | Perkins, Jr. | 229/185 |
| 4,418,863 | 12/1983 | Kimbrell, Sr. | 229/120 |
| 4,583,678 | 4/1986 | Weimer, Jr. | 229/185 |

FOREIGN PATENT DOCUMENTS

| | | | |
|---|---|---|---|
| 2240156 | 3/1975 | France | 229/30 |

*Primary Examiner*—Willis Little

[57] ABSTRACT

A produce transport and cooling container of a generally boxlike shape with bottom support panels having retroverse tabs and apertures which strengthen the container bottom as progressively heavier loads are added. Lid and drainage apertures, and stacking projections, allow the containers to be stacked in a stable manner, and cool water misted over the produce to keep it fresh during transit.

9 Claims, 12 Drawing Figures

Fig.-9
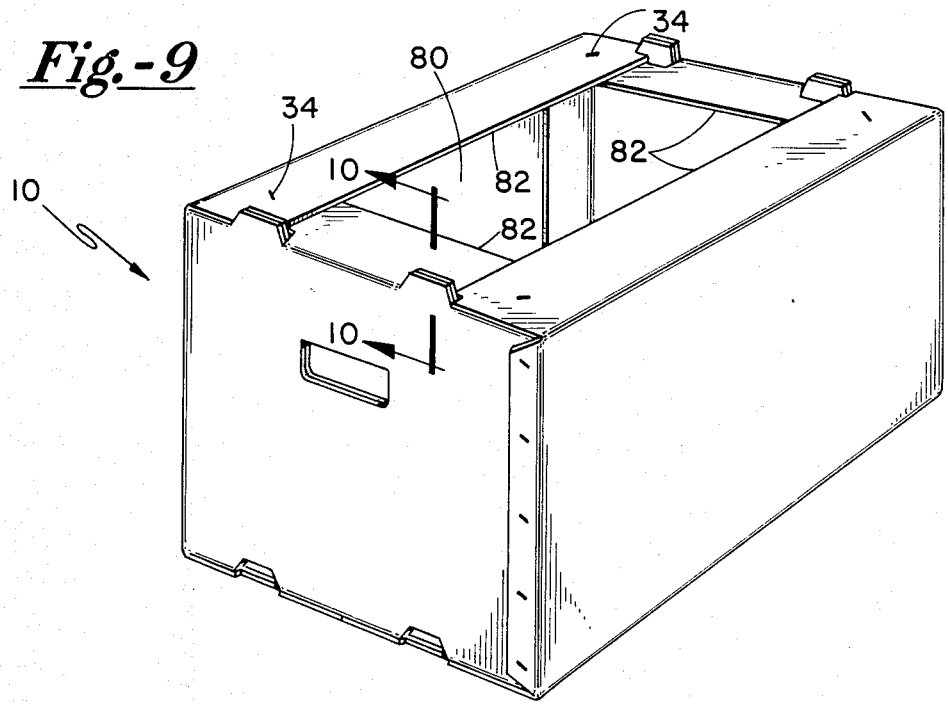
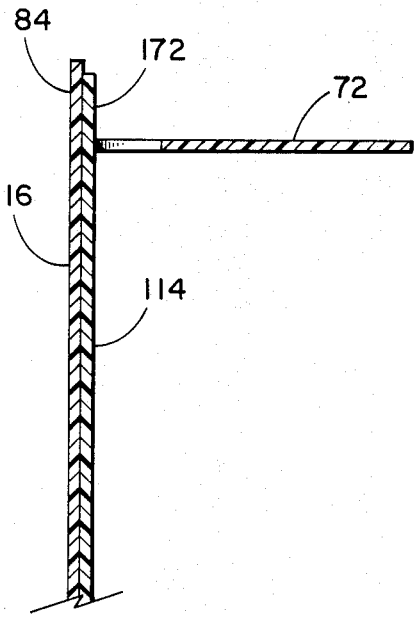
Fig.-10
Fig.-11
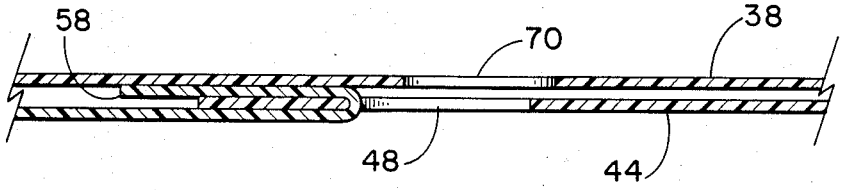

PRODUCE TRANSPORT AND COOLING CONTAINER AND METHOD FOR USING SAME

BACKGROUND OF THE INVENTION

Containers for storing and transporting produce have long been used in the fruit and vegetable marketing industry. The primary requirements of such containers are that they be strong and durable, inexpensive to manufacture and use, and of suitable dimensions to hold the particular items being stored or transported.

Cartons with trays or comprtments to hold fragile items in place during transit are not uncommon. Inserts and liners to protect delicate foodstuffs from rough handlers or the natural elements are often included in packaging designs.

The universally accepted choice among materials for constructing these cartons has been corrugated fiberboard. Because of its light weight, fiberboard does not add unduly to the total weight of the shipment when compared with wood cartons, therefore helping to keep transportation costs at a minimum. Though fiberboard is relatively weak and susceptible to moisture and deterioration, the fact that it is an inexpensive material to manufacture cartons from makes those cartons readily disposable.

One drawback inherent to cardboard and fiberboard containers—not merely cartons to transport produce, but any container folded from cardboard or fiberboard which is fastened together along overlapping or abutting panels—is their tendency to weaken and tear as progressively heavier loads are placed inside them. This is particularly true if the cartons have base supporting panels which overlap and are fastened together. The predominant trend has been toward containers with one-piece base and sidewall construction which eliminate any fastened joints between at least two of the side walls of the container and the base support panel, thus forming a unified U-shaped side wall and base panel configuration.

One limitation to current designs is that, once such a container is folded and fastened, it cannot later be unfastened and unfolded or laid flat for storage without destroying the container. A second limitation has been the need to use some external means to restrain a stack of cartons while in transit, such as ropes, netting, webbing belts, or tapes. Cardboard has a relatively smooth surface with a low coefficient of friction, and while handles or handgrips may be used to allow people to hold the cartons while carrying them, some device is necessary to prevent the top cartons from sliding off a stack when the cartons are being shipped.

In addition to designing a container which is inexpensive yet provides reasonable measures of durability and protection for the produce, one goal has also been to find methods to keep perishable goods as fresh as possible with a minimum of spoilage. Consequently, corrugated fiberboard containers with perforations and ventilation holes have been used, and transportation vehicles equipped with refrigeration are common.

Periodically misting or humidifying fruits and vegetables has been shown to be beneficial for preserving the freshness, flavor, texture, and color of many such items. Numerous United States patents have disclosed systems for misting or humidifying produce in display cases at the point of sale. Such systems would be impractical to use in transport vehicles, however, because the misting would severely delapidate standard cardboard and fiberboard cartons, and the time and expense involved in removing the produce from cartons to place them on drainage shelves within the vehicle and subsequently repacking them at the destination would destroy any advantage obtained by using the misting system.

One object of this invention is to fashion a folded container which may be quickly and easily folded flat, yet which presents a means for connecting overlapping base support panels in such a manner that they become stronger as the weight of the load in the container is increased.

Another object of this invention is to construct a stackable container with these stated advantages which interlocks with like-designed cartons to prevent a stack of cartons from shifting in transit.

An additional object of this invention is to present a design for a produce storage and transportation container which will maintain its strength and integrity despite being exposed to moisture from the container's cargo, the natural elements, or an artificial source of humidity or misted water.

Yet another object of this invention is to present a method for keeping fruits and vegetables fresh during transit by misting cool water directly on the produce while it remains in the cartons within the transport vehicle, permitting adequate drainage of excess water and not deteriorating the cartons.

An additional object of this invention is to accomplish the above advantages using a container which is relatively inexpensive and easy to manufacture, yet will be more durable and versatile than existing containers.

SUMMARY OF THE INVENTION

The container of this invention is a recangular carton made from corrugated plastic and having relatively upright side and end walls and four overlapping bottom panels. The first bottom support panel has one or more apertures which correspond with retroverse tab extensions on the edge of the overlayed bottom panel. These tab extensions project upwardly through the apertures and ore folded backwards to form locking joints which provide increasing support for the bottom of the container as more weight is added to a load placed in that container.

The base support panels have a number of drainage holes passing through the bottom of the container. Sections of the side and end walls adjacent the top of the container may be folded over horizontally along score lines to form lid flaps which partially cover the top of the container, and are fastened together at overlapping corners. The inner edges of those lid flaps define an aperture through the top of the container with a perimeter corresponding in size and location to the placement of the drainage holes beneath.

The lid flaps, when they are folded to their horizontal position, form a stacking ledge upon which other like containers may be stacked. Small cutouts in the lid flaps along the score lines connecting those lid flaps to the side walls permit sections of the side wall to project above the top of the container when the lid flaps are folded over. When a number of containers are stacked one atop another, these projections on a lower container correspond with and fit into notches on the bottom edges of the container above. The projections and notches prevent the containers from shifting or sliding off the sack when they are being transported.

By stacking the containers with the lid apertures of the containers positioned directly below the drainage holes in the bottom of the containers, cool water may be continuously misted onto the top of the stack and allowed to run down through each successive container and collected at the bottom of the stack. This permits the produce to be kept particularly fresh without becoming water-logged or mildewed, does not permit the water to become stagnant, and does not adversely affect the integrity of the carton itself.

Internal reinforcing panels are placed inside the container parallel to an abutting the end walls. These reinforcing panels have end extensions which are folded at ninety degree angles along vertical score lines matching the inside vertical edges of the container. The reinforcing panels may also have companion notches and projections to correspond with the notches and projections on the container body. These reinforcing panels add great strength to support additional containers stacked on top, while adding very little weight to, and not limiting the internal volume of, the container.

BRIEF DESCRIPTION OF THE DRAWINGS

FIG. 9 is a perspective view of the assembled container.

FIG. 10 is a cross sectional view of the side of the container taken through line 10—10 in FIG. 9.

FIG. 11 is a cross sectional view of the bottom flaps of the container taken through line 11—11 in FIG. 6.

DESCRIPTION OF THE PREFERRED EMBODIMENT

The produce transport and cooling container of this invention is shown in FIGS. 1–12 and referenced generally by the numeral 10.

The container 10 is formed from a single sheet of corrugated plastic cut to produce a blank 12 which is then scored into panels and folded into the shape of the container 10.

Figure 3:
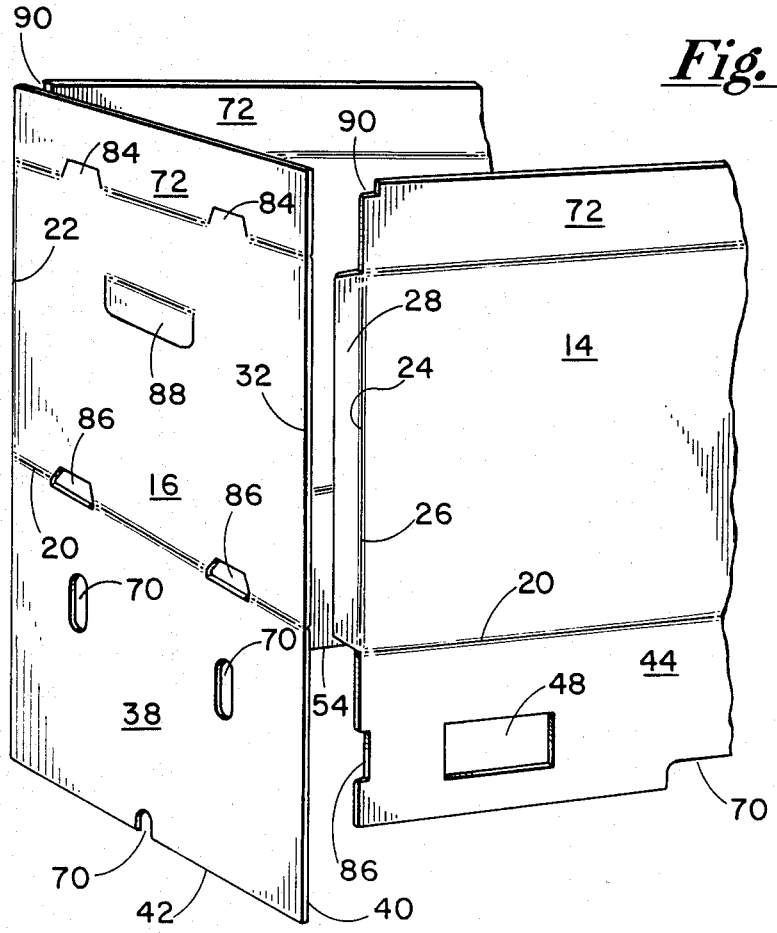
FIG. 3 is a perspective view of the container showing the vertical sidewalls.

The container 10 comprises an alternating series of two vertical side walls 14 and two vertical end walls 16 each having a top edge 18 and a bottom edge 20. The side walls 14 and end walls 16 are hingedly connected at their adjacent edges along score lines 22 which extend continuously between the top edges 18 and bottom edges 20. Extending from the exposed free edge 24 of one of the side walls 14, and hingedly connected thereto along a scored line 26, is a wall fastening flap 28. The side walls 14 and end walls 16 are folded over score lines 22 at ninety degree angles to form a four-sided upright receptacle 30 as shown in FIGS. 3 and 9. The wall fastening flap 28 is then folded inward at a ninety degree angle to contact the surface of the end wall 16 adjacent its free end 32 and is fastened thereto using fastening means 34 such as staples or sonic welds.

Figure 4:
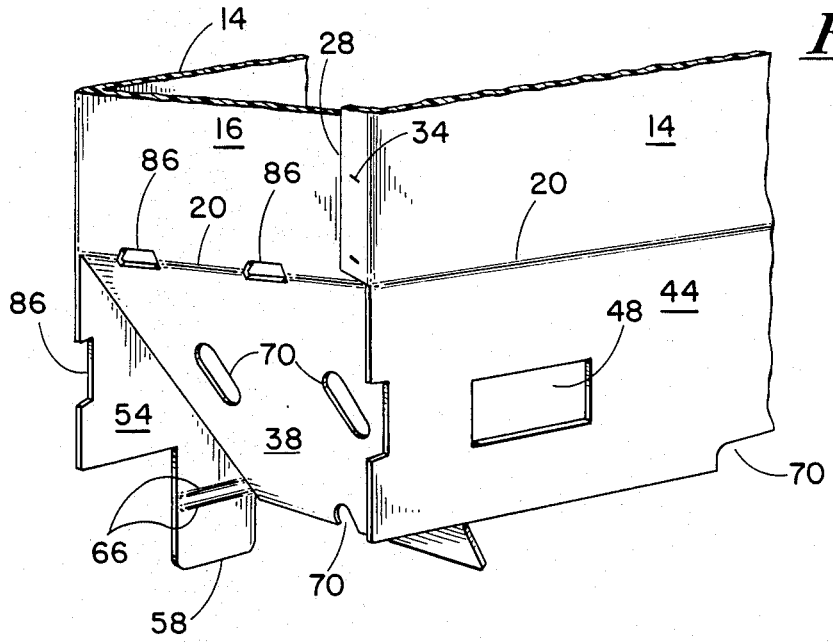
FIG. 4 is a perspective view of the bottom of the container showing the bottom panels being folded inwardly.

Extending from the bottom edge 20 of each end wall 16 a distance approximately equal to half the length of the side walls 14, and hingedly connected to the end walls 16 along score lines 36, is an inner bottom panel 38. The inner bottom panels 38 are folded upward at ninety degree angles over the score lines 36 as shown in FIG. 4, so that the side edges 40 of the inner bottom panels 38 are adjacent the bottom edges 20 of the side walls 14, and the end edges 42 of the inner bottom panels 38 are adjacent to and in touching proximity with one another.

Extending from the bottom edge 20 of one of the side walls 14 a distance approximately equal to half the width of the end walls 16 is a first bottom support panel 44, hingedly connected to the side wall 14 along a score line 46. Bottom edge 20 generally coincides with score line 26. The first bottom support panel 44 defines two generally rectangular apertures 48 spaced equidistantly from the end edges 50 and the center 52 thereof.

Extending from the bottom edge 20 of the other side wall 14 a distance approximately equal to half the width of the end walls 16 is an overlapping bottom panel 54, hingedly connected to the side wall 14 along score line 56. The overlapping bottom panel 54 has two retroverse extension tabs 58 extending from its free edge 60 and spaced equidistantly from the end edges 62 and the center 64 thereof.

Figure 5:
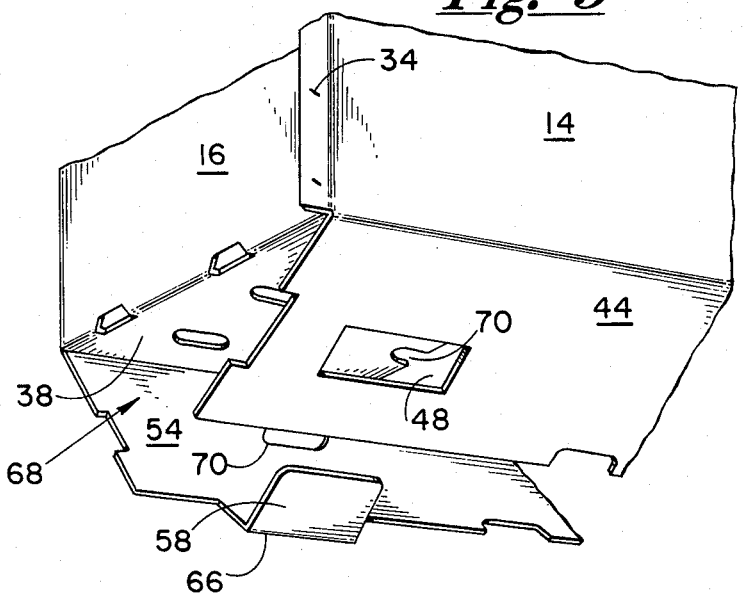
FIG. 5 is a perspective view of the bottom of the container showing the bottom support panels being folded inwardly.
Figure 6:
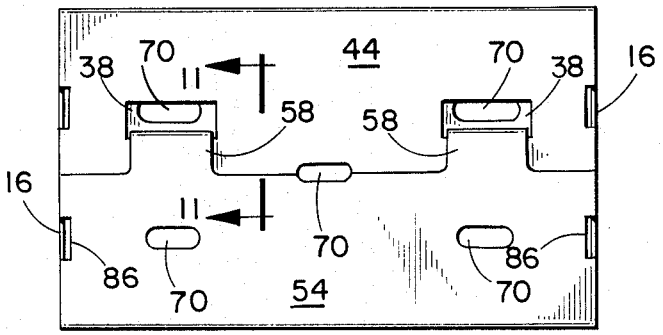
FIG. 6 is a view of the bottom of the container completely assembled.

As indicated in FIG. 5, the first bottom support panel 44 is folded upwardly at a ninety degree angle over score line 46, and the overlapping bottom support panel 54 is then folded upward at a ninety degree angle over score line 56. At the same time, the retroverse extension tabs 58 may be partially folded over double score lines 66 and inserted through the apertures 48 in the first bottom support panel 44, and then folded completely over at a one hundred eighty degree angle within the envelope 68 formed between the inner bottom panels 38 on top and the first bottom support panel 44 and overlaying bottom support panel 54 beneath.

In operation, weight placed in the container 10 will exert pressure downward on the inner bottom panels 38 and compress the envelope 68, which in turn holds the retroverse extension tabs 58 firmly within the apertures 48 so that the bottom support panels 44, 54 are securely locked together. It may be appreciated that inner bottom panels 38 would not be needed for all containers wherein the weight could be placed directly on the retroverse extension tabs 58.

A number of drainage apertures 70 of generally oblate shape are positioned longitudinally and extend through the surface of the inner bottom panels 38, and are placed latitudinally and extend through the surface of the first bottom support panel 44 and the overlaying bottom support panel 54, so that the apertures 70 in the inner bottom panels 38 are in overlapping fluid communication with the apertures 70 of the bottom support panels 44, 54 when the container 10 is folded to form the interior receptacle 30. The apertures 48 through which the retroverse extension tabs 58 extend may be positioned and enlarged to replace two of the drainage apertures 70.

Figure 1:
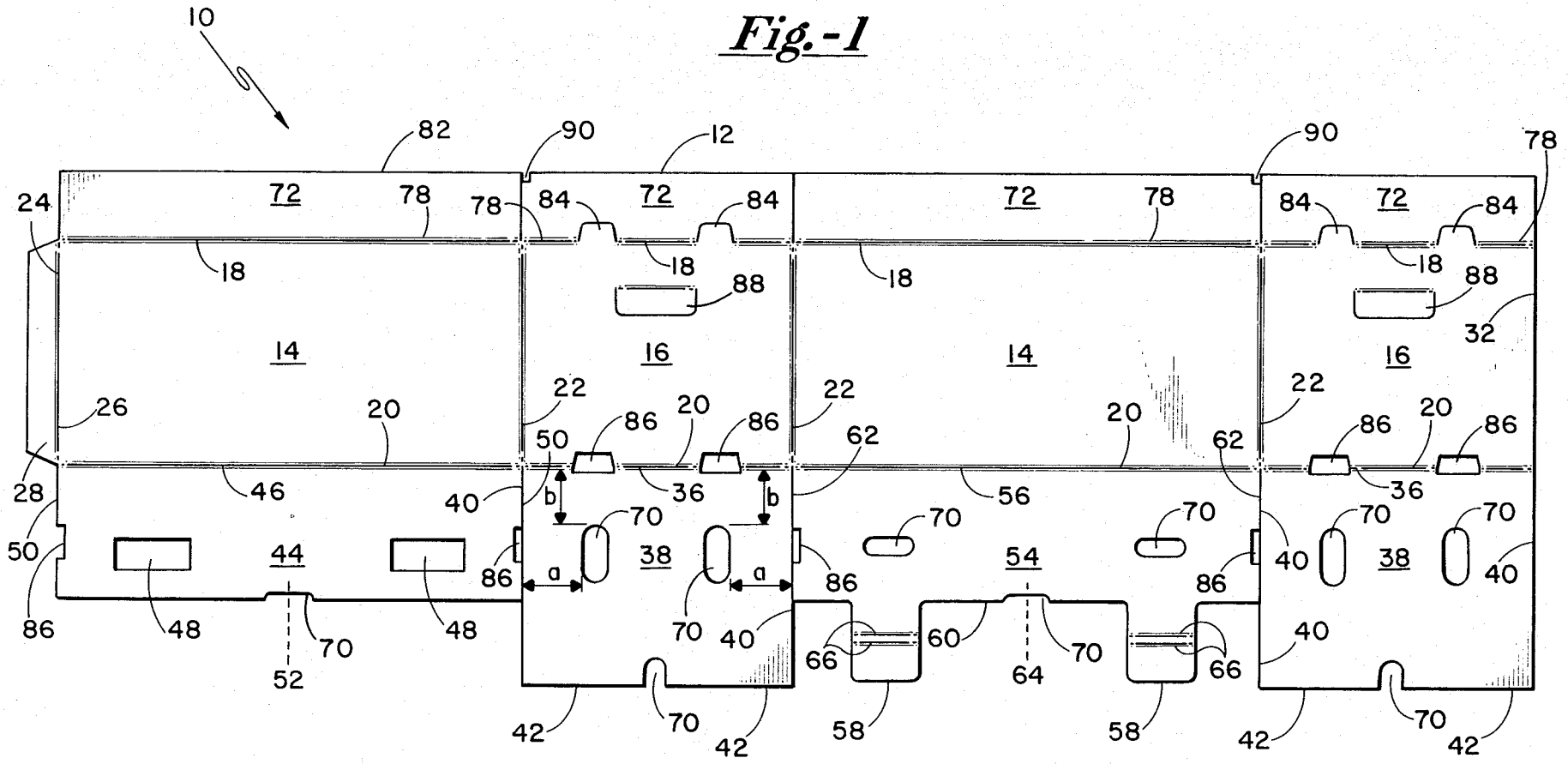
FIG. 1 is a top plan view of the cut and scored blank used to form the container.

Lid flaps 72 extend from the top edge 18 of each side wall 14 and end wall 16 a distance approximately equal to the lesser of: the distance a between the end edges 40 of the inner bottom panels 38 and the closest outer edge of the drainage apertures 70, and the distance b between the bottom edge 36 of the end walls 16 and the closest outer edge of the drainage apertures 70, as shown in FIG. 1.

Figure 8:
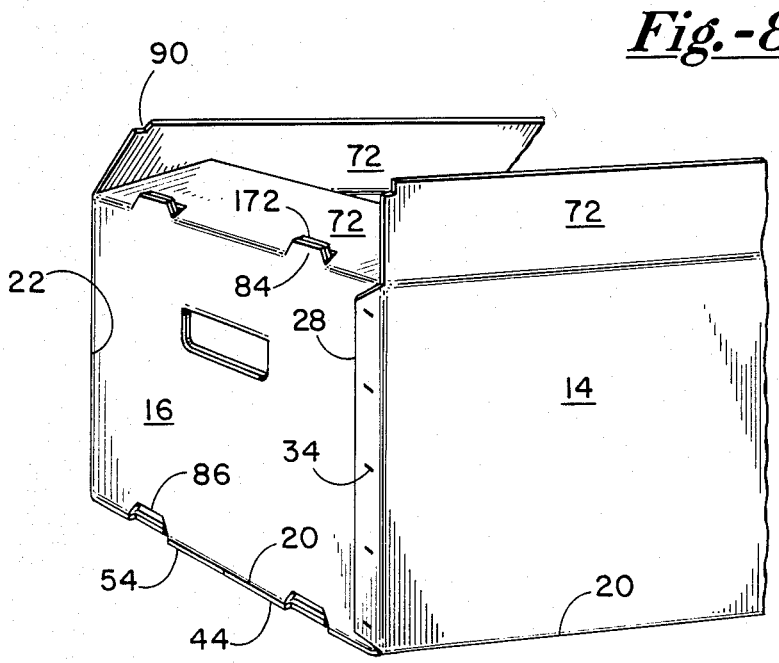
FIG. 8 is a perspective view of the top of the container showing the lid flaps being folded inwardly.

The lid flaps 72 are hingedly connected to each side wall 14 and end wall 16 along and, are folded at ninety degree angles over score lines 78 in the manner shown in FIG. 8 and are fastened together using fastening means 34 such as a staple or sonic weld in the horizontally extending positions shown in FIG. 9.

These dimensions a, b for the lid flaps 72 insure that when a container 10 is stacked on top of like-designed container 10 with the side walls 14 and end walls 16 of one container 10 in substantially the same planes as the side walls 14 and end walls 16 of the other container 10, the lid aperture 80 defined by the inner edges 82 of the lid flaps 72 on the bottom container 10 will encompass and fluidly communicate with the drainage apertures 70 of the top container 10.

Figure 7:
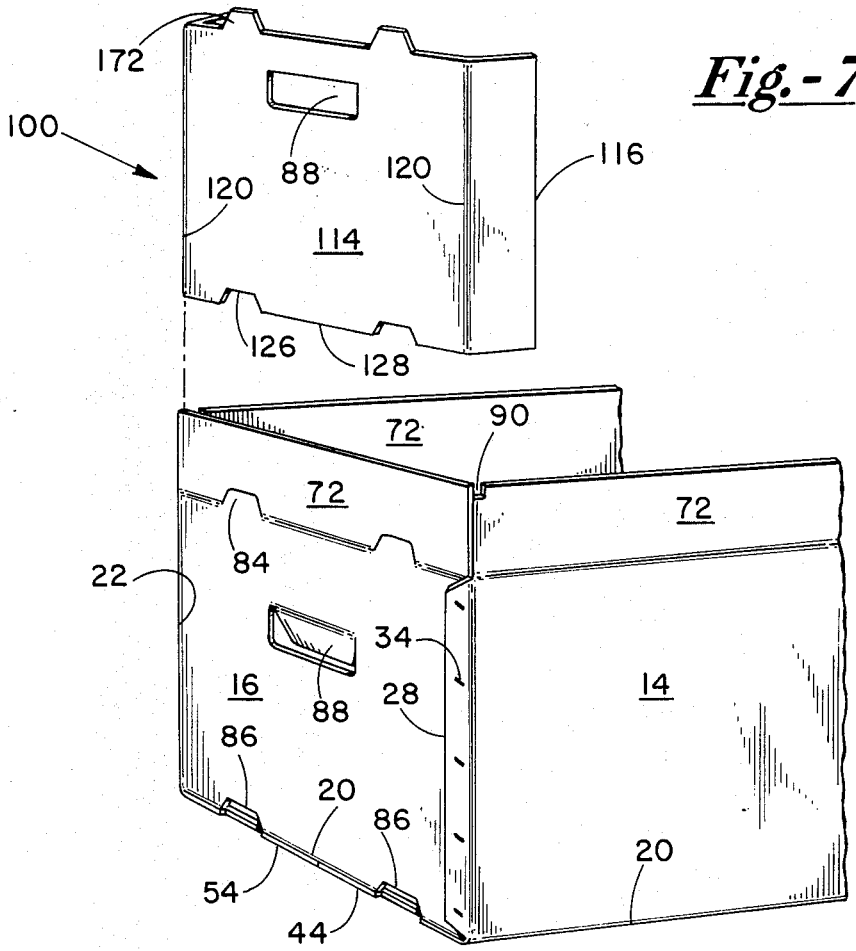
FIG. 7 is a perspective view of the top of the container showing the path insert of an internal reinforcing panel as it is inserted.
Figure 12:
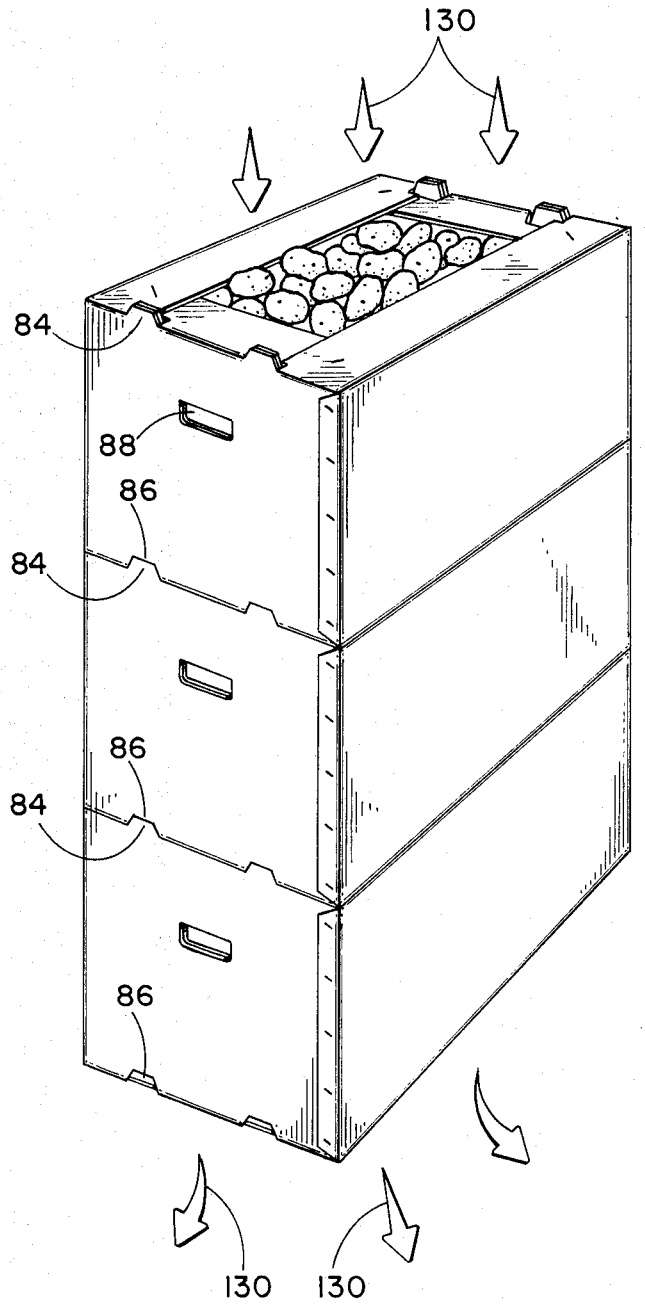
FIG. 12 is a perspective view of a stack of similar containers filled with produce having water misted on the top of the stack.

Stacking projections 84 extending upward from the top edges 18 of the end walls 16 as shown in FIGS. 7, 8, and 9 are cut from the lid flaps 72 and are fully exposed when flaps 2 are folded inwardly. Notches 86 are cut in the bottom edges 20 of the side walls, end edge 50 of the first bottom support panel 44, and the end edge 62 of the overlaying bottom support panel 54 to communicate with and accommodate the stacking projections 84 of a like-designed container 10 when those containers 10 are stacked. The stacking projections 84 prevent a stacked container 10 from sliding off the top of the container 10 below when a plurality of containers are stacked as shown in FIG. 12. Handgrip openings 88 may be cut in the walls 14, 16 of the container 10. The corners 90 of the lid flaps 72 may be cut out to accommodate the stacking projections 84.

Figure 2:
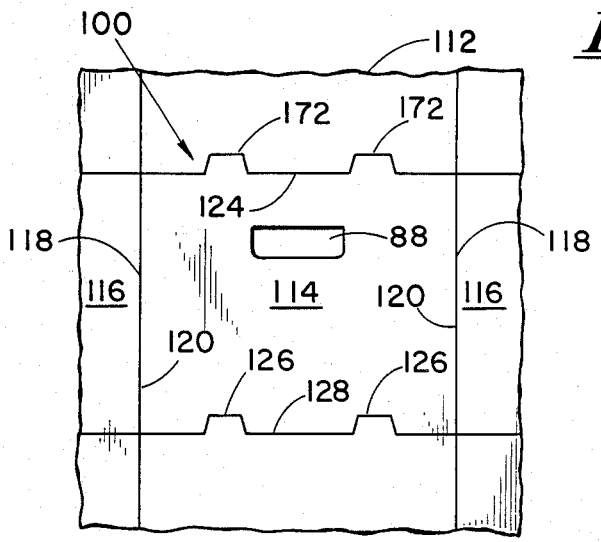
FIG. 2 is a top plan view of the cut and scored blank used to form the internal reinforcing panels.

Internal reinforcing panels 110 as shown in FIG. 2 are cut from a blank sheet of corrugated plastic 112, scored into end panels 114 of approximately the same size as the container end walls 16, with side flaps 116 extending from and hingedly connected to each end edge 118 of the end panel 114 along score lines 120. The side flaps 116 are folded at ninety degree angles over the score lines 120, and the internal reinforcing panel 110 is placed inside the container 10 so that the planar surfaces of the end panels 114 and end walls 14 are in parallel abutting contact. FIG. 7 is an exploded view showing reinforcing panel placement. Side flaps 116 are ultimately disposed in abutting, overlying relation to the ends of side walls 14. Internal stacking projections 122 extend upwardly from the top edge 124 of the internal reinforcing panel 114, and internal notches 126 are cut into the bottom edge 128 of the internal reinforcing panel 114 to communicate with the stacking projections 84 and notches 86 of the container 10, respectively. Handgrip openings 88 corresponding to those in the container end walls 16 are cut in the internal reinforcing panels 110.

In operation during storage or transit, several of the containers 10 of this invention may be filled with produce 128 and stacked one atop another as shown in FIG. 12. Cold water 130 may then be misted onto the top of the container 10 adjacent the lid aperture 80, allowing the water to cool and rehydrate the produce 128, and then trickle down through the drainage apertures 70 in the inner bottom panels 38 and bottom support panels 44, 54 and out of the container 10, and then in through the lid aperture 80 of the container 10 below, repeating this cycle until the water 130 is collected outside the bottom container 10 of the stack to be recooled and recycled or discarded.

What is claimed is:

1. A produce transport and cooling container comprising:

four substantially rectangular and generally vertical wall panels each having a top edge and a bottom edge, and assembled to form a generally box-shaped receptacle; and at least two bottom support panels extending generally downward from the bottom edges of two opposing said wall panels and hingedly connected thereto along score lines, said bottom support panels each having a bottom edge, one of said bottom panels defining one or more apertures extending through the surface of said panel proximate to said bottom edge of said bottom support panel, the other of said bottom support panels having the same number of retroverse tabs extending from the bottom edge of said other bottom support panel as the number of said apertures, said retroverse tabs positioned along said bottom edge of said other bottom support panel to overlap and communicate with said apertures when said bottom support panels are folded upwardly and inwardly at generally right angles along said score lines to a horizontal position between said vertical wall panels, said retroverse tabs having one or more score lines traversing said retroverse tabs adjacent to and in overlapping comunication with said apertures, said retroverse tabs being insertable through said apertures and foldable over and generally parallel the planar surfaces of said bottom support panels.

2. The container of claim 1 wherein the number of said bottom support panels is two and further comprising:

a pair of inner bottom panels extending from the bottom edges of opposing walls and hingedly connected thereto along score lines substantially perpendicular to the hinged connections of said bottom support panels, said inner bottom panels folded upwardly and inwardly at generally right angles over said score lines to a horizontal position lying above said bottom support panels with said retroverse tabs situated therebetween.

3. The container of claim 2 further comprising:

a plurality of stacking projections, said stacking projections extending generally vertically upward from the top edge of said walls; and a plurality of notches, said notches cut into adjacent and overlapping sections of said bottom support panels and said walls, said notches positioned to embracingly communicate with the stacking projections of a like container when said container is stacked on top of said like container.

4. The container of claim 2 wherein said bottom support panels and said inner bottom panels define a plurality of drainage apertures extending through the surfaces of said bottom support panels and said inner bottom panels in overlapping and fluid communication.

5. The container of claim 4 further comprising two or more lid flaps hingedly connected to said walls along score lines, said lid flaps being folded inward at generally right angles over said score lines to define a lid aperture between said lid flaps, said lid aperture positioned to overlap and encompass and fluidly communicate with the drainage apertures of a like container when said like container is placed over said container with the walls of said containers in substantially parallel planar relation.

6. The container of claim 5 further comprising at least two hand grip openings, said hand grip openings extending through the surface of opposing said walls proximate to the top edge of said walls.

7. The container of claim 6 further comprising internal reinforcing panels, said panels having an internal end wall substantially congruent with and in parallel abutting relation to one of said walls, one or more side flaps hingedly connected to said internal end wall along a score line, and said side flaps folded at substantially right angles over said score lines.

8. The container of claim 4 wherein the container is cut, scored, and folded from a single sheet of corrugated plastic.

9. The method of storing and transporting perishable foodstuff such as produce which consists of the steps of:

placing the produce into containers having lid apertures at the top of said containers and drainage apertures at the bottom of said containers;

stacking said containers in a vertically aligned column with a top and a bottom container, the drainage apertures of one container in fluid communication with the lid apertures of a like container below said one container; and supplying cooled water to the top of said column;

whereby the cooled water flows into the top container through the lid aperture, over the foodstuff, out through the drainage apertures of the top container, and successively through the stacked containers to the drainage apertures of the bottom container.

* * * * *